US006952153B2

(12) United States Patent
Jacobson et al.

(10) Patent No.: US 6,952,153 B2
(45) Date of Patent: Oct. 4, 2005

(54) ELECTRICAL TRANSFORMER

(75) Inventors: Boris Solomon Jacobson, Westford, MA (US); Bruce William Chignola, Marlboro, MA (US); Garo Dakessian, Dover, MA (US); Dennis Robert Kling, Milford, MA (US); Kevin Edward Martin, Dracut, MA (US); Eberhardt Praeger, Wayland, MA (US); William Edward Wesolowski, Holden, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/357,595

(22) Filed: Feb. 4, 2003

(65) Prior Publication Data

US 2004/0150502 A1 Aug. 5, 2004

(51) Int. Cl.[7] ..... H01F 5/00

(52) U.S. Cl. ..... 336/200; 336/223; 336/232; 336/83

(58) Field of Search ..... 336/200, 223, 336/232, 83, 65, 96, 229, 205; 29/602.1

(56) References Cited

U.S. PATENT DOCUMENTS

| | | | | |
|---|---|---|---|---|
| 5,191,699 A | | 3/1993 | Ganslmeir et al. | |
| 5,949,321 A | | 9/1999 | Grandmount | 336/232 |
| 5,973,923 A | | 10/1999 | Jitaru | 361/704 |
| 5,990,776 A | | 11/1999 | Jitaru | 336/200 |
| 5,999,078 A | | 12/1999 | Herbert | 336/172 |
| 6,198,374 B1 | * | 3/2001 | Abel | 336/200 |
| 6,285,273 B1 | * | 9/2001 | Morikawa | 336/200 |
| 6,388,551 B2 | * | 5/2002 | Morikawa | 336/223 |
| 2003/0011458 A1 | | 1/2003 | Nuytkens et al. | |

FOREIGN PATENT DOCUMENTS

| | | |
|---|---|---|
| EP | 0 756 298 A2 | 1/1997 |
| EP | 0 851 439 A1 | 7/1998 |
| EP | 1 085 536 A1 | 3/2001 |

OTHER PUBLICATIONS

PCT International Search Report PCT/US2004/002465, no date.

PCT International Search Report PCT/US2004/002465.

* cited by examiner

*Primary Examiner*—Lincoln Donovan
*Assistant Examiner*—Jennifer A. Poker
(74) *Attorney, Agent, or Firm*—Daly, Crowley, Mofford & Durkee, LLP

(57) ABSTRACT

An electrical transformer having primary winding segments and secondary winding segments interconnected, respectively, by first and second multilevel printed circuit boards disposed in a pair of overlaying planes and additional segments disposed perpendicular to the overlaying planes.

14 Claims, 6 Drawing Sheets

ELECTRICAL TRANSFORMER

TECHNICAL FIELD

This invention relates to electrical transformers, and more particularly to compact electrical transformers.

BACKGROUND

As is known in the art, electrical transformers have a wide variety of applications. The transformer includes a primary winging and an adjacent secondary winding. Changes in electrical current passing through the primary winding induce a corresponding change in a magnetic field around the primary winding. This changing magnetic field induces a corresponding change in current in the adjacent, magnetically coupled secondary winding.

As is also known in the art, it is desirable to reduce the size of the transformer.

SUMMARY

In accordance with the present invention, an electrical transformer is provided having a first dielectric. The first dielectric includes a plurality of first electrically isolated electrical conductor segments. A second dielectric is disposed over, and in registration with, the first dielectric, such second dielectric having a plurality of second electrically isolated electrical conductor segments disposed on the second dielectric. The transformer includes a core having an aperture therein, such aperture extending between the first and second dielectrics. A plurality of third electrically isolated electrical conductor segments is provided. First ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a portion of a primary winding and a portion of a secondary winding for the transformer. The primary winding comprises first ones of the first electrically isolated electrical conductor segments, first ones of the second electrically isolated electrical conductor segments, and first ones of the third electrically isolated electrical conductor segments. The secondary winding comprises second ones of the first electrically isolated electrical conductor segments, second ones of the second electrically isolated electrical conductor segments, and second ones of the third electrically isolated electrical conductor segments.

In one embodiment, the first and second dielectrics comprise multilevel printed circuit boards.

In one embodiment, the first and second multilevel printed circuit boards are disposed in a pair of overlaying planes and the plurality of third electrically isolated electrical conductor segments are disposed perpendicular to the overlaying planes.

In one embodiment, the primary and secondary winding provide loops around the core.

In one embodiment, the third electrically isolated electrical conductor segments are embedded within the core.

In one embodiment, the core comprises a toroidal shaped body and the dielectric body is disposed in a central region of the toroidal shaped body.

In accordance with another feature of the invention, an electrical transformer is provided having a first multilayer printed circuit board. The first multilevel printed circuit board includes a plurality of first electrically isolated electrical conductor segments disposed on each one of a plurality of electrically isolated levels of such first multilevel printed circuit board. A second multilayer printed circuit board is, disposed over, and in registration with, the first multilevel printed circuit board. The second multilevel printed circuit board has a plurality of second electrically isolated electrical conductor segments disposed on each one of a plurality of electrically isolated levels of such second multilevel printed circuit board. A pair of dielectric bodies is disposed between the first multilevel printed circuit board and the second multilevel printed circuit board. Each one of such bodies has disposed therein a plurality of third electrically isolated electrical conductor segments. First ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a primary winding and a secondary winding for the transformer. The primary winding comprises a first ones of the first electrically isolated electrical conductor segments, first ones of the second electrically isolated electrical conductor segments, and first ones of the third electrically isolated electrical conductor segments. The secondary winding comprises second ones of the first electrically isolated electrical conductor segments, second ones of the second electrically isolated electrical conductor segments, and second ones of the third electrically isolated electrical conductor segments.

In accordance with another feature of the invention, an electrical transformer structure is provided. The structure includes a first multilayer printed circuit board having a plurality of first electrically isolated electrical conductor segments disposed on each one of a plurality of electrically isolated levels of such first multilevel printed circuit board. The structure includes a second multilayer printed circuit board, disposed over, and in registration with, the first multilevel printed circuit board. The second multilevel printed circuit board has a plurality of second electrically isolated electrical conductor segments disposed on each one of a plurality of electrically isolated levels of such second multilevel printed circuit board. A dielectric spacer member is disposed between the first multilevel printed circuit board and the second multilevel printed circuit board. The spacer member has a plurality of apertures therethrough. The apertures in the spacer member pass between a top and a bottom surface of the spacer member. A plurality of toroidal shaped cores is provided. Each one of such cores is disposed in a corresponding one of the plurality of apertures of the dielectric spacer member. Each one of the cores has an aperture therein, the apertures of the cores being coaxial with the apertures in the dielectric spacer member. A plurality of dielectric bodies is provided. Each one of such dielectric bodies is disposed in a corresponding one of the apertures in the cores. A plurality of plurality of dielectric bodies has a corresponding one of the sets of third electrically isolated electrical conductor segments. First ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a primary winding and a secondary winding for the transformer. The primary winding comprises first ones of the first electrically isolated electrical conductor segments, first ones of the second electrically isolated electrical conductor segments, and first ones of the third electrically isolated electrical conductor segments. The secondary winding comprises second ones of the first electrically isolated electrical conductor segments, second ones of the second electrically isolated electrical conductor segments, and second ones of the third electrically isolated electrical conductor segments.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
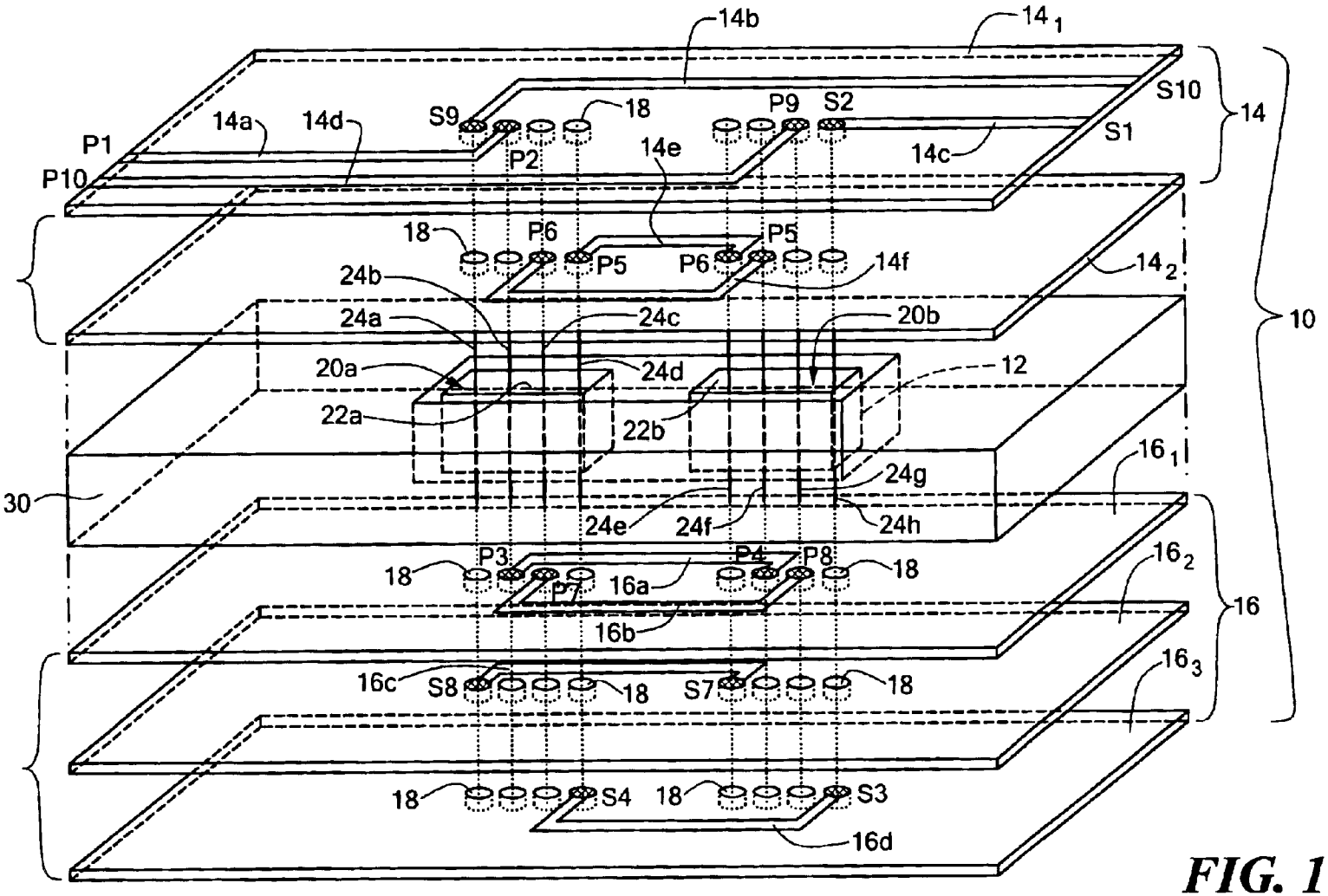
FIG. 1 is a an exploded view of an electrical transformer according to the invention.

Referring now to FIG. 1, an electrical transformer 10 is shown having a core 12, here, for example, a ferrite core, disposed between a pair of dielectrics 14, 16, here, for example, a pair of multilevel printed circuit boards 14, 16 as shown. The first multilayer printed circuit board 14 has a plurality of first electrically isolated electrical conductor segments 14*a*–14*f* disposed on each one of a plurality of electrically isolated levels, or dielectric boards $\mathbf{14}_1$ and $\mathbf{14}_2$ of such first multilevel printed circuit board 14. Thus, electrically isolated electrical conductor segments 14*a*–14*d* are on different electrically isolated regions of dielectric board $\mathbf{14}_1$ of board 14 and electrically isolated electrical conductor segments 14*e* and 14*f* are on different electrically isolated regions of dielectric board $\mathbf{14}_2$ of board 14.

The second multilayer printed circuit board 16 is disposed under, and is in registration with, the first multilevel printed circuit board 14. The second multilevel printed circuit board has a plurality of second electrically isolated electrical conductor segments 16*a*–16*d* disposed on each one of a plurality of electrically isolated levels of such second multilevel printed circuit board 16. Thus, electrically isolated electrical conductor segments 16*a* and 16*b* are on different electrically isolated regions of dielectric board $\mathbf{16}_1$ of board 16, electrically isolated electrical conductor segment 16*c* is on dielectric board $\mathbf{16}_2$ of board 16, and electrical conductor segment 16*d* is on dielectric board $\mathbf{16}_3$ of board 16. Each one of the boards has electrically conductive plated through holes, one portion of the plated through holes being indicated by the numerical designation 18 and the other portion being indicated by the designation $S_2$-$S_9$ and $P_2$-$P_9$.

It is noted that:

electrically conductive segment 14*a* has ends thereof connected between port $P_1$ and plated through hole $P_2$;

electrically conductive segment 14*b* has ends thereof connected between plated through hole $S_9$ and port $S_{10}$;

electrically conductive segment 14*c* has ends thereof connected between plated through hole $S_2$ and port $S_1$;

electrically conductive segment 14*d* has ends thereof connected between plated through hole $P_9$ and port $P_{10}$;

electrically conductive segment 14*e* has ends thereof connected between plated through hole $S_5$ and plated through hole $P_5$;

electrically conductive segment 14*f* has ends thereof connected between plated through hole $P_6$ and plated through hole $P_5$;

electrically conductive segment 16*a* has ends thereof connected between plated through hole $P_3$ and plated through hole $P_4$;

electrically conductive segment 16*b* has ends thereof connected between plated through hole $P_7$ and plated through hole $P_8$;

electrically conductive segment 16*c* has ends thereof connected between plated through hole $S_8$ and plated through hole $S_7$; and electrically conductive segment 16*d* has ends thereof connected between plated through hole $S_4$ and plated through hole $S_3$.

Figure 2:
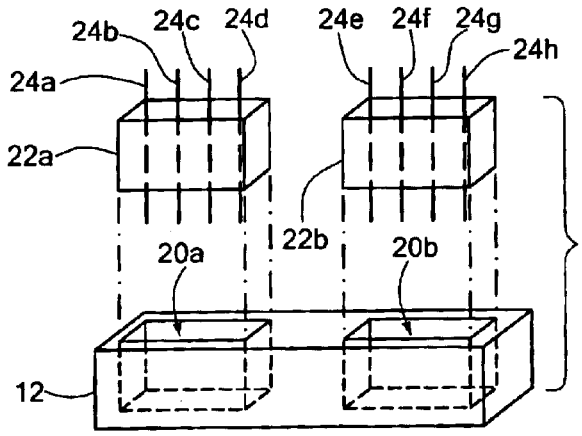
FIG. 2 is an exploded view of a core and a pair of dielectric bodies having electrical conductor segments therein used in the transformer of FIG. 1.

The core 12, shown more clearly in FIG. 2, has a plurality of apertures 20*a*, 20*b* therethrough. When assembled, the apertures 20*a*, 20*b* extends between the first and second multilevel printed circuits boards 14, 16, as shown in FIG. 1. A pair of dielectric bodies, here for example, printed circuit boards 22*a*, 22*b* are disposed in the apertures 20*a*, 20*b*, respectively as shown. Each one of the dielectric bodies 22*a*, 22*b* has disposed therein a plurality of electrically isolated electrical conductor segments, 24*a* through 24*h*, as shown. Thus, here body 22*a* has electrical conductor segments 24*a*–24*d* thereon and body 22*b* has electrical conductor segments 24*e*–24*h*, thereon, as shown.

Figure 3:
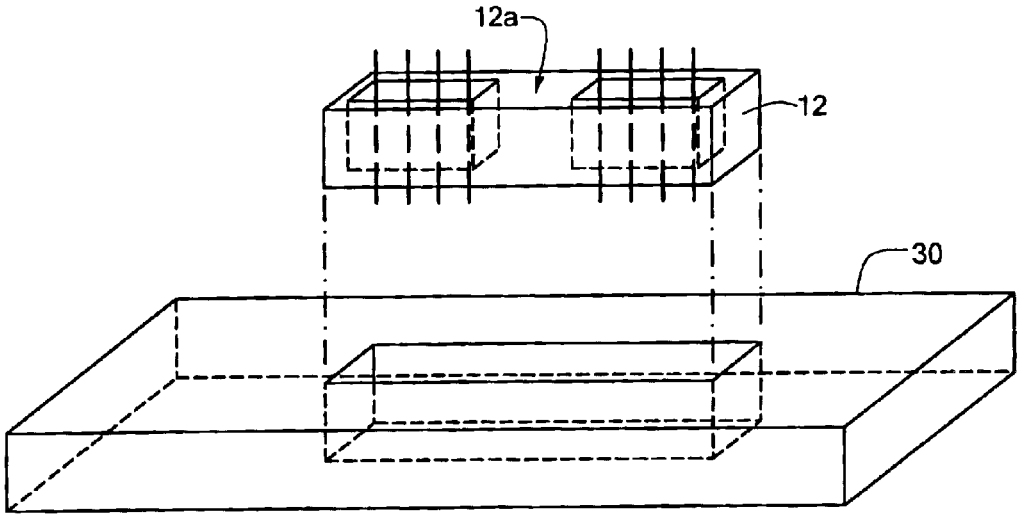
FIG. 3 is an exploded view of the assembled core and a pair of dielectric bodies having electrical conductor segments therein of FIG. 2 and a dielectric spacer used in the transformer of FIG. 1.

The core 12 with the dielectric bodies 22*a*, 22*b* with the electrical conductor segments 24*a*–24*h* are inserted into a dielectric spacer 30, as shown in FIGS. 1 and 3.

It is noted that the first and second multilevel printed circuit boards 14, 16 are disposed in a pair of overlaying planes and the plurality of electrically isolated electrical conductor segments 24*a*–24*h* are disposed perpendicular to the overlaying planes.

When assembled, first ends, here the upper ends in FIG. 1, of the electrically isolated electrical conductor segments 24*a*–24*h* are electrically connected to the electrically isolated electrical conductor segments 14*a*–14*f* and second ends, here the lower ends of the electrically isolated electrical conductor segments 24*a*–24*h* are electrically connected to the electrically isolated electrical conductor segments 16*a*–16*h* through the electrically plated through holes $S_2$-$S_9$ and $P_2$-$P_9$. More particularly, when assembled:

the upper ends of electrical conductor segments 24*a*–24*h* are electrically connected to plated through holes $S_9$, $P_2$, $P_6$, $S_5$, $S_6$, $P_5$, $P_9$ and $S_2$, respectively; and the lower ends of electrical conductor segments 24*a*–24*h* are electrically connected to plated through holes $S_8$, $P_3$, $P_7$, $S_4$, $S_7$, $P_4$, $P_8$ and $S_3$, respectively With such connections, a primary winding of the transformer 10 comprises port $P_1$, electrical conductor segments 14*a*, 24*b*, 16*a*, 24*f*, 14*f*, 24*c*, 16*b*, 24*h*, 14*d* and port $P_{10}$ and a secondary winding comprises port $S_1$, electrical conductor segments 14*c*, 24*h*, 16*d*, 24*d*, 14*e*, 24*e*, 16*d*, 24*a*, 14*b* and port $S_{10}$.

It is noted that the primary and secondary winding provide loops around the portion 12*a* (FIG. 3) of the core 12. Further, it is noted that the electrically isolated electrical conductor segments 24*a*–24*h* are embedded within the core 12.

Figure 4:
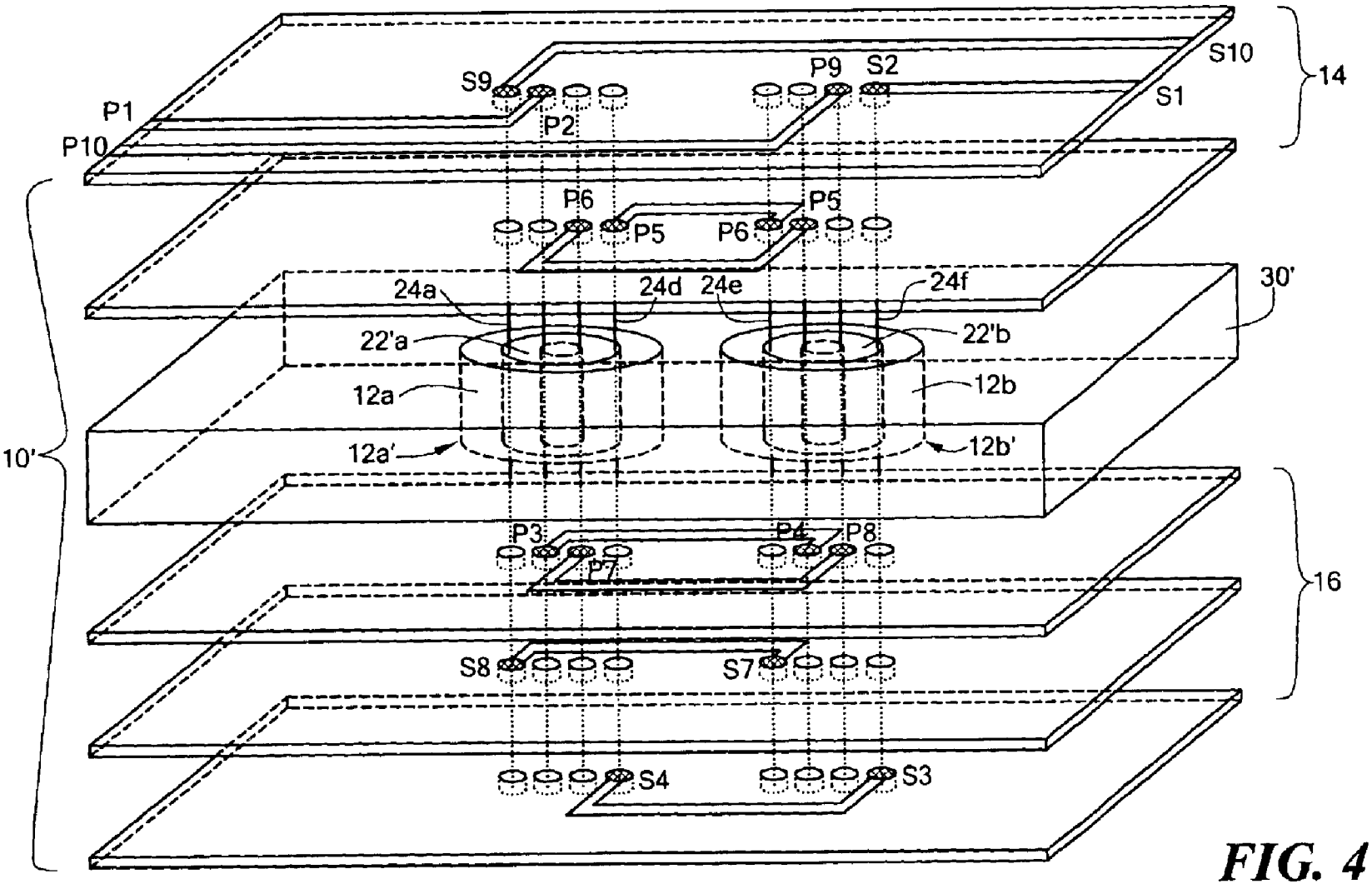
FIG. 4 is a an exploded view of an electrical transformer according to another embodiment of the invention.

Referring now to FIG. 4, another embodiment is shown. Here, the transformer 10' has the pair of multilevel printed circuit boards, 14 and 16, as described above in connection with FIGS. 1, 2 and 3. Here, however, adjacent portions of a pair of toroidal shaped cores 12*a*, 12*b* provide the core. The pair of toroidal shaped cores 12*a*, 12*b* are disposed within a pair of apertures provided through the dielectric spacer 30', as shown. A pair of circular shaped dielectric bodies 22'*a*, 22'*b* having the electrically conductive segments 24*a*–24*b* are disposed within a corresponding one of the central, apertured, regions of the toroidal shaped bodies 12*a*, 12*b* as shown.

When assembled, first ends, here the upper ends in FIG. 4, of the electrically isolated electrical conductor segments 24*a*–24*h* are electrically connected to the electrically isolated electrical conductor segments 14*a*–14*f* and second ends, here the lower ends of the electrically isolated electrical conductor segments 24*a*–24*h* are electrically connected to the electrically isolated electrical conductor segments 16*a*–16*h* through the electrically plated through holes $S_2$-$S_9$ and $P_2$-$P_9$. More particularly, when assembled:

the upper ends of electrical conductor segments 24*a*–24*h* are electrically connected to plated through holes $S_9$, $P_2$, $P_6$, $S_5$, $S_6$, $P_5$, $P_9$ and $S_2$, respectively; and the lower ends of electrical conductor segments 24*a*–24*h* are electrically connected to plated through holes $S_8$, $P_3$, $P_7$, $S_4$, $S_7$, $P_4$, $P_8$ and $S_3$, respectively With such connections, a primary winding of the transformer 10 comprises port $P_1$, electrical conductor segments 14*a*, 24*b*, 16*a*, 24*f*, 14*f*, 24*c*, 16*b*, 24*g*, 14*d* and port $P_{10}$ and a secondary winding comprises port $S_1$, electrical conductor segments 14*c*, 24*h*, 16*d*, 24*d*, 14*e*, 24*e*, 16*d*, 24*a*, 14*b* and port $S_{10}$.

Thus, here the primary and secondary winding provide loops around the portion 12*a* (FIG. 3) of the adjacent portions 12*a*' and 12*b*' of the cores 12*a* and 12*b*. Further, it is noted that the electrically isolated electrical conductor segments 24*a*–24*h* are embedded within the cores 12*a* and 12*b*, as shown. It is noted that segments 24*b*, 24*c*, 24*f* and 24*g* provide the vertical portions of the primary loop and segments 24*h*, 24*d*, 24*e* and 24*a* provide the vertical portions of the secondary loop.

Figure 5:
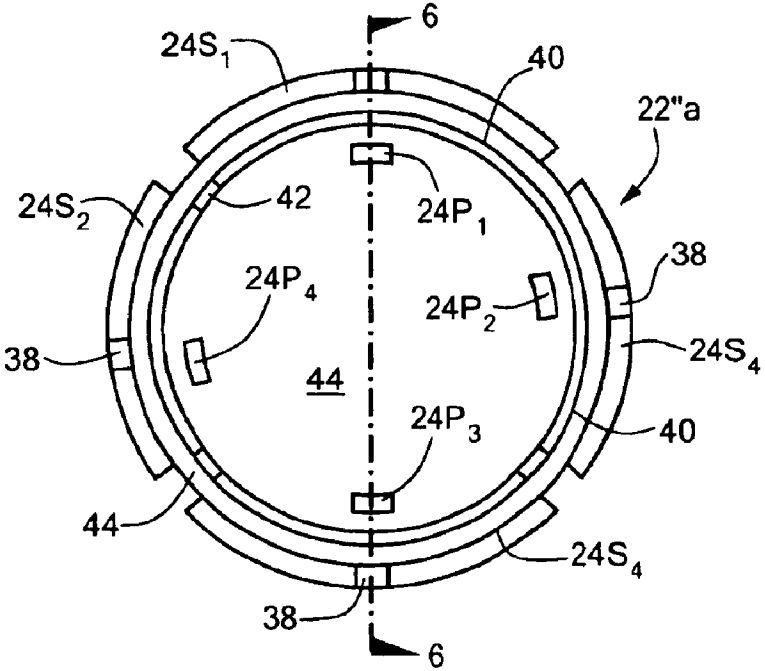
FIG. 5 is a top view of a dielectric body having electrical conductor segments therein used in the transformer of FIG. 4.

It should be understood that the number of conductive segments through the dielectric bodies 22*a*, 22*b* or 22*a*', 22*b*' might be larger than the four segments shown with the number of conductive segments of the printed circuit boards being correspondingly increased. Thus, referring now to FIGS. 5 and 6, a modified exemplary one of the dielectric bodies 22'*a* and 22'*b*, here body 22"*a* is shown. Here, the body 22"*a* has eight conductive segments 24'$S_1$-24'$S_4$ and 24$P_1$-24$P_4$. The conductive segments 24'$S_1$-24'$S_4$ provide the vertical portions of the secondary loop and the conductive segments 24'$P_1$-24'$P_4$ provide the vertical portions of the primary loop. The eight conductive segments 24'$S_1$-24'$S_4$ and 24$P_1$-24$P_4$ have upper and lower conductive tabs 38 for making electrical connection to the plated through holes of the multilevel printed circuit boards 14, 16. Here, there is an electrically conductive shield 40 disposed between the segments 24'$S_1$-24'$S_4$ and the segments 24$P_1$-24$P_4$. The electrically conductive shield 40 has tabs 42 for connection to a ground plane, not shown, of the multilevel printed circuit boards, 14, and 16 and a vertical cutout that prevents the shield from introducing a shorted turn in the transformer. Here, the electrical conductor segments 24'$S_1$-24'$S_4$ and 24$P_1$-24$P_4$ and the shield 40 are copper and are embedded within an epoxy filler 44.

As noted above, the body 22"*a* is disposed within the central region of the toroidal shaped core 12*a*.

Figure 6:
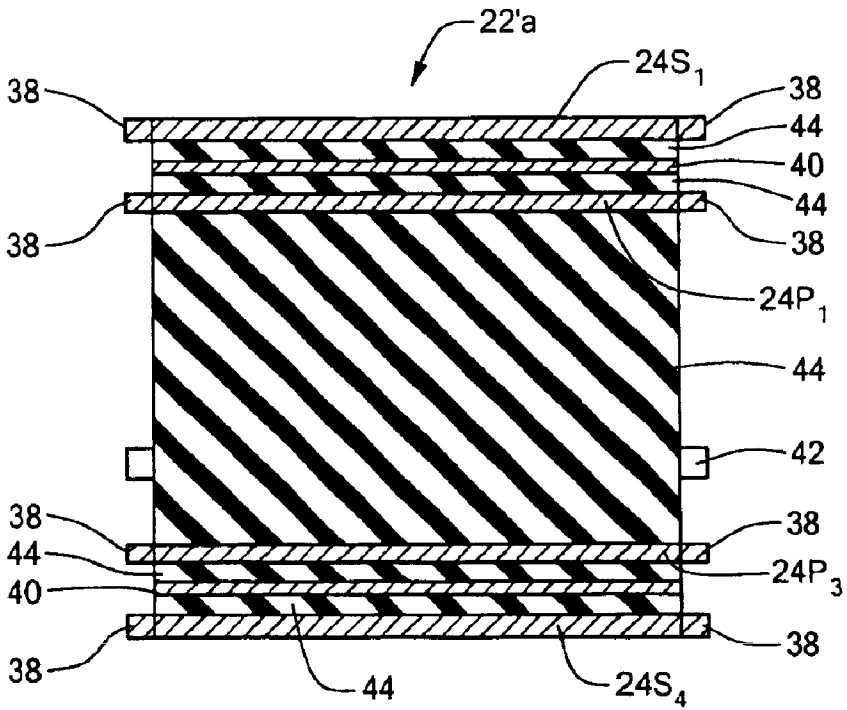
FIG. 6 is cross-sectional view of the dielectric body having electrical conductor segments therein of FIG. 5, such cross section being taken along line 6—6 in FIG. 5.
Figure 7:
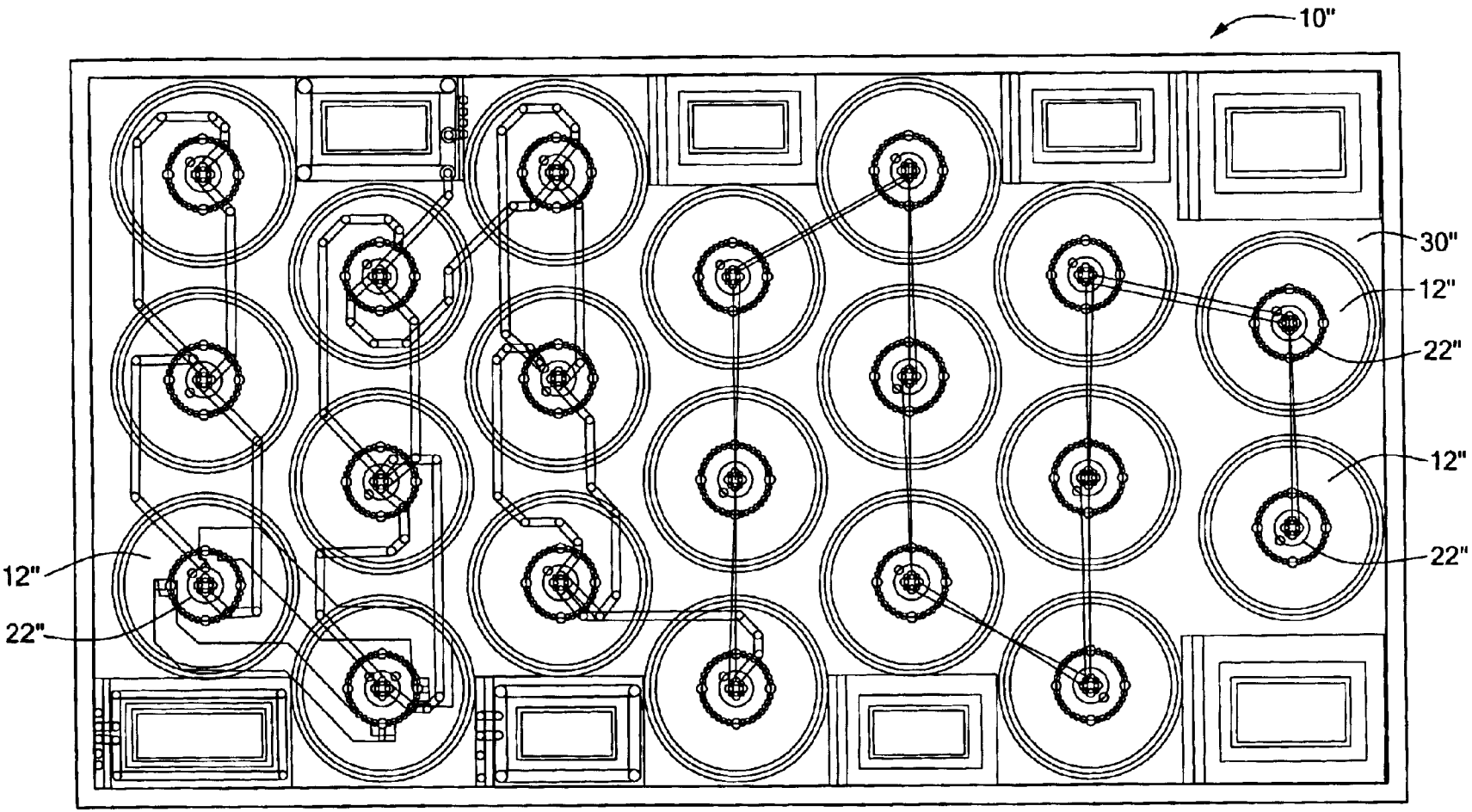
FIG. 7 is top view of a transformer according to another embodiment of the invention, such transformer having an array of the dielectric bodies having electrical conductor segments therein of FIG. 5, such top view showing only a partial routing of primary winding used in such transformer.
Figure 8:
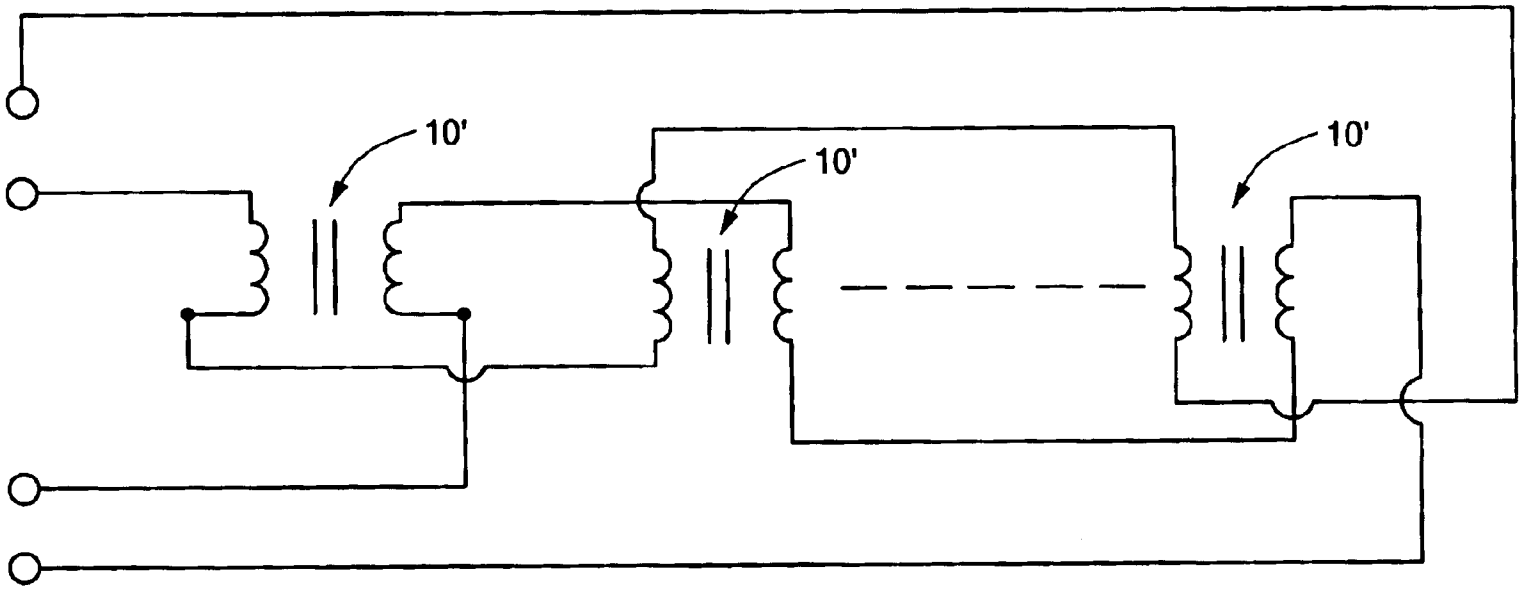
FIG. 8 is a schematic diagram of primary and second winding segments connected to provide the transformer of FIG. 7.

Referring now to FIG. 7, an electrical transformer 10" is shown here with the upper multilayer printed circuit board 14 illustrated with only the electrical conductive segments used to interconnect transformer segments to be described in connection with FIG. 8. Here, the dielectric spacer member 30" has a plurality of, here 20, apertures therethrough. The apertures in the spacer member 30" pass between a top and a bottom surface of the spacer member. A plurality of toroidal shaped cores 12", as shown in FIG. 4 is provided. Each one of such cores 12" is disposed in a corresponding one of the plurality of apertures of the dielectric spacer member 30". Each one of the cores 12" has an aperture therein, the apertures of the cores 12" being coaxial with the apertures in the dielectric spacer member 30". A plurality of dielectric bodies, here the body 22" as described above in connection with FIGS. 5 and 6 is provided. Each one of such dielectric bodies 22" is disposed in a corresponding one of the apertures in the cores 12".

Thus, a plurality of plurality of dielectric bodies 22" has a corresponding one of the vertical electrically isolated electrical conductor segments 24$S_1$-24$S_4$ and 24$P_1$-24$P_4$, as described above in connection with FIGS. 5 and 6. The ends or tabs 38 of the electrical conductor segments are electrically connected to electrically isolated electrical conductor segments of the upper and lower multilevel printed circuits boards. Here, however, the boards 14, 16 are modified to provide not only primary and secondary windings, or loops around each one of the toroidal shaped cores, i.e., to provide a transformer segment 10', as shown in FIG. 8, but the conductor segments on the multilevel printed circuit boards are used to electrically interconnect each one of the transformer segments 10' as shown in FIG. 8, and thereby provide a larger transformer assembly 10".

A number of embodiments of the invention have been described. Nevertheless, it will be understood that various modifications may be made without departing from the spirit and scope of the invention. Accordingly, other embodiments are within the scope of the following claims.

What is claimed is:

1. An electrical transformer, comprising:

a first multilayer printed circuit board having a plurality of first electrically isolated electrical conductor segments disposed on each one of a plurality of electrically isolated levels of such first multilevel printed circuit board;

a second multilayer printed circuit board, disposed over, and in registration with, the first multilevel printed circuit board, such second multilevel printed circuit board having a plurality of second electrically isolated electrical conductor segments disposed on each one of a plurality of electrically isolated levels of such second multilevel printed circuit board;

a core having an aperture therein, such aperture extending between the first and second multilevel printed circuits boards;

a dielectric body disposed in the aperture, such body having disposed therein a plurality of third electrically isolated electrical conductor segments; and wherein first ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a portion of a primary winding and a portion of a secondary winding for the transformer;

wherein such primary winding comprises first ones of the first electrically isolated electrical conductor segments, first ones of the second electrically isolated electrical conductor segments, and first ones of the third electrically isolated electrical conductor segments; and wherein such secondary winding comprises second ones of the first electrically isolated electrical conductor segments, second ones of the second electrically isolated electrical conductor segments, and second ones of the third electrically isolated electrical conductor segments.

2. The electrical transformer recited in claim 1 wherein the first and second multilevel printed circuit boards are disposed in a pair of overlaying planes and wherein the plurality of third electrically isolated electrical conductor segments are disposed perpendicular to the overlaying planes.

3. The electrical transformer recited in claim 2 wherein the primary and secondary winding provide loops around the core.

4. The electrical transformer recited in claim 3 wherein the core material comprises a toroidal shaped body and wherein dielectric body is disposed in a central region of the toroidal shaped body.

5. The electrical transformer recited in claim 1 wherein each one of the third conductor segments has a pair of electrically conductive tabs, each one of the tabs extending beyond a corresponding one of a pair of opposing ends of the dielectric body, each one the tabs being electrically connected to a corresponding one of the printed circuit boards.

6. An electrical transformer, comprising:

a first multilayer printed circuit board having a plurality of first electrically isolated electrical conductor segments disposed on each one of a plurality of electrically isolated levels of such first multilevel printed circuit board;

a second multilayer printed circuit board, disposed over, and in registration with, the first multilevel printed circuit board, such second multilevel printed circuit board having a plurality of second electrically isolated electrical conductor segments disposed on each one of a plurality of electrically isolated levels of such second multilevel printed circuit board;

a pair of dielectric bodies disposed between the first multilevel printed circuit board and the second multilevel printed circuit board, each one of such bodies having disposed therein a plurality of third electrically isolated electrical conductor segments; and wherein first ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a primary winding and a secondary winding for the transformer;

wherein such primary winding comprises first ones of the first electrically isolated electrical conductor segments, first ones of the second electrically isolated electrical conductor segments, and first ones of the third electrically isolated electrical conductor segments; and wherein such secondary winding comprises second ones of the first electrically isolated electrical conductor segments, second ones of the second electrically isolated electrical conductor segments, and second ones of the third electrically isolated electrical conductor segments.

7. The electrical transformer recited in claim 6 wherein the first and second multilevel printed circuit boards are disposed in a pair of overlaying planes and wherein the plurality of third electrically isolated electrical conductor segments are disposed perpendicular to the overlaying planes.

8. The electrical transformer recited in claim 7 including a core material disposed between the first and second multilevel printed circuit boards and wherein the primary and secondary winding provide loops around the core material.

9. The electrical transformer recited in claim 8 wherein the core material comprises a pair of adjacent, toroidal shaped bodies and each one of the a pair of dielectric bodies is disposed in a central region of a corresponding one of the pair of toroidal shaped bodies.

10. An electrical transformer structure, comprising:

a first multilayer printed circuit board having a plurality of first electrically isolated electrical conductor segments disposed on each one of a plurality of electrically isolated levels of such first multilevel printed circuit board;

a second multilayer printed circuit board, disposed over, and in registration with, the first multilevel printed circuit board, such second multilevel printed circuit board having a plurality of second electrically isolated electrical conductor segments disposed on each one of a plurality of electrically isolated levels of such second multilevel printed circuit board;

a dielectric spacer member disposed between the first multilevel printed circuit board and the second multilevel printed circuit board, such spacer member having a plurality of apertures therethrough, such apertures passing between a top and a bottom surface of the spacer member;

a plurality of toroidal shaped cores, each one of such cores being disposed in a corresponding one of the plurality of apertures of the dielectric spacer member, each one of the cores having an aperture therein, the apertures of the cores being coaxial with the apertures in the dielectric spacer member;

a plurality of dielectric bodies, each one of such dielectric bodies being disposed in a corresponding one of the apertures in the cores and having disposed therein portions of a corresponding one of the sets of third electrically isolated electrical conductor segments;

wherein first ends of the third electrically isolated electrical conductor segments are electrically connected to the plurality of first electrically isolated electrical conductor segments and second ends of the third electrically isolated electrical conductor segments are electrically connected to the plurality of second electrically isolated electrical conductor segments to provide a primary winding and a secondary winding for the transformer;

wherein such primary winding comprises first ones of the first electrically isolated electrical conductor segments, first ones of the second electrically isolated electrical conductor segments, and first ones of the third electrically isolated electrical conductor segments; and wherein such secondary winding comprises second ones of the first electrically isolated electrical conductor segments, second ones of the second electrically isolated electrical conductor segments, and second ones of the third electrically isolated electrical conductor segments.

11. The electrical transformer recited in claim 10 wherein the first and second multilevel printed circuit boards are disposed in a pair of overlaying planes and wherein the plurality of third electrically isolated electrical conductor segments are disposed perpendicular to the overlaying planes.

12. The electrical transformer recited in claim 11 including wherein the primary and secondary winding provide loops around the cores.

13. The electrical transformer recited in claim 5 wherein such third conductor segments have electrically conductive surfaces portions, such surface portions being disposed about an outer surface portion of the dielectric body.

14. The electrical transformer recited in claim 5 wherein each one of the third conductor segments has a surface portion having opposing edges, wherein the tabs have width portions projecting from edges of the electrically conductive surfaces, and wherein the edges have lengths longer than the width portions.

* * * * *

UNITED STATES PATENT AND TRADEMARK OFFICE

CERTIFICATE OF CORRECTION

PATENT NO. : 6,952,153 B2
DATED : October 4, 2005
INVENTOR(S) : Boris Jacobson et al.

It is certified that error appears in the above-identified patent and that said Letters Patent is hereby corrected as shown below:

Column 3,
Line 31, delete "FIG. 6 is cross-sectional" and replace with -- FIG. 6 is a cross-sectional --.
Line 34, delete "FIG. 7 is top view" and replace with -- FIG. 7 is a top view --.

Column 6,
Line 39, delete "a plurality of plurality of" and replace with -- a plurality of --.

Column 7,
Line 43, delete "wherein dielectric body" and replace with -- wherein a dielectric body --.

Column 8,
Line 36, delete "of the a pair" and replace with -- of the pair --.

Column 10,
Line 12, delete "surfaces portions," and replace with -- surface portions, --.

Signed and Sealed this

Ninth Day of May, 2006

JON W. DUDAS
*Director of the United States Patent and Trademark Office*